US008414360B2

(12) United States Patent
Lee et al.

(10) Patent No.: US 8,414,360 B2
(45) Date of Patent: Apr. 9, 2013

(54) DOUBLE SIDE POLISHING APPARATUS AND CARRIER THEREFOR

(75) Inventors: Chi-Bok Lee, Gumi-si (KR); Heui-Don Cho, Gumi-si (KR)

(73) Assignee: Siltron, Inc., Gumi (KR)

( * ) Notice: Subject to any disclaimer, the term of this patent is extended or adjusted under 35 U.S.C. 154(b) by 485 days.

(21) Appl. No.: 12/700,362

(22) Filed: Feb. 4, 2010

(65) Prior Publication Data

US 2011/0045748 A1 Feb. 24, 2011

(30) Foreign Application Priority Data

Aug. 21, 2009 (KR) ..... 10-2009-0077525

(51) Int. Cl.
*B24B 7/17* (2006.01)
*B24B 41/06* (2012.01)

(52) U.S. Cl.
USPC ..... 451/262; 451/269; 451/385; 451/400

(58) Field of Classification Search ..... 451/65, 451/287, 398, 57, 262, 268, 269, 385
See application file for complete search history.

(56) References Cited

U.S. PATENT DOCUMENTS

| | | | | |
|---|---|---|---|---|
| 6,296,554 | B1 * | 10/2001 | Lai et al. | 451/271 |
| 6,454,635 | B1 * | 9/2002 | Zhang et al. | 451/41 |
| 7,008,308 | B2 * | 3/2006 | Bjelopavlic et al. | 451/269 |
| 7,815,489 | B2 * | 10/2010 | Pietsch et al. | 451/7 |
| 8,137,157 | B2 * | 3/2012 | Fletcher et al. | 451/41 |
| 2002/0115387 | A1 * | 8/2002 | Wenski et al. | 451/41 |
| 2008/0166952 | A1 | 7/2008 | Ueno | |
| 2009/0305615 | A1 * | 12/2009 | Uchiyama | 451/57 |

FOREIGN PATENT DOCUMENTS

| | | |
|---|---|---|
| JP | 11-267963 | 10/1999 |
| KR | 10-2007-0110033 | 11/2007 |

* cited by examiner

*Primary Examiner* — Dung Van Nguyen
(74) *Attorney, Agent, or Firm* — Greer, Burns & Crain, Ltd.

(57) ABSTRACT

A double side polishing apparatus comprises an upper polishing plate and a lower polishing plate for polishing both sides of a wafer; a plurality of carriers, each including a center plate and a circumferential plate, the center plate having a mounting hole where the wafer is mounted, the circumferential plate having a fitting hole where the center plate is fitted and a gear part formed along the outer periphery thereof, the center of the mounting hole being eccentric from the center of the center plate, the center of the fitting hole being eccentric from the center of the circumferential plate; and a sun gear and an internal gear engaged with the gear part to transmit a rotational force to the plurality of carriers, wherein a fitting direction of a center plate into a fitting hole is adjustable for at least two carriers among the plurality of carriers.

17 Claims, 9 Drawing Sheets

DOUBLE SIDE POLISHING APPARATUS AND CARRIER THEREFOR

CROSS-REFERENCE TO RELATED APPLICATION

This application claims priority to Korean Patent Application No. 10-2009-0077525 filed in Republic of Korea on Aug. 21, 2009, the entire contents of which are incorporated herein by reference.

BACKGROUND OF THE INVENTION

1. Field of the Invention

The present invention relates to a carrier for a double side polishing apparatus and a double side polishing apparatus using the same, and more particularly, to a carrier on which a wafer's physical location can be adjusted to induce an optimum quality polishing process, and a double side polishing apparatus using the same.

2. Description of the Related Art

Mainly, a silicon wafer fabrication process includes a slicing process for slicing a single crystal ingot into thin disc-shaped wafers, a chamfering process for chamfering the edges of the wafer to prevent defects of the wafer such as crack, chipping, fissure and so on, a lapping process for flattening the wafer, an etching process for removing any residual damage from the wafer, a polishing process for mirror-polishing the surface of the wafer, and a cleaning process for removing impurities from the wafer. Additional processes may be added or a fabrication process sequence may be changed according to fabrication environment, specification of a target wafer and so on.

The polishing process may be classified into a single side polishing process and a double side polishing process. The double side polishing (DSP) process polishes both sides of a wafer, i.e., an upper side and a lower side.

A double side polishing apparatus used to perform the double side polishing process is described below in detail with reference to FIG. 1.

The double side polishing apparatus 10 comprises an upper polishing plate 150 having a polishing pad attached to a lower surface thereof, a lower polishing plate 110 installed opposite to the upper polishing plate 150 and having a polishing pad attached to an upper surface thereof, and a carrier 130 installed between the upper polishing plate 150 and the lower polishing plate 110 for mounting a wafer 100 to be polished.

An internal gear 120 is located along the outer periphery of the lower polishing plate 110, and a sun gear 140 is installed at the center of the double side polishing apparatus 10. At least one carrier 130 having a wafer mounted therein is engaged with the internal gear 120 and the sun gear 140, and rotates accordingly.

As the carrier 130 rotates by the internal gear 120 and the sun gear 140, a wafer mounted in the carrier 130 also rotates. A frictional force is generated by a rotational motion between the wafer and the polishing pads of the upper and lower polishing plates 150 and 110 in contact with the wafer. The wafer is polished by the frictional force together with a reaction of a polishing slurry containing abrasive particles and various kinds of additives.

The internal gear 120 and the sun gear 140 are capable of independent rotation. The extent (cycle, number of times and so on) of revolution and rotation of the carrier is determined according to a rotational speed of each gear 120 and 140 about an axis.

The wafer mounted in the carrier 130 makes a rotational motion corresponding to the extent of revolution or rotation of the carrier 130.

Meanwhile, the upper and lower polishing plates 150 and 110 of the double side polishing apparatus 10 are manufactured through a lapping process. Thus, although the upper and lower polishing plates 150 and 110 are manufactured by the same manufacturer, they may have a processing deviation caused by the lapping process in consideration of size (of the upper polishing plate or the lower polishing plate), and may have different flatness or shapes for each manufacturer as shown in FIG. 2.

As shown in FIG. 3, repetition of the polishing process at a great pressure increases the temperature of the upper and lower polishing plates, resulting in physical deformation of the upper and lower polishing plates. In FIG. 3, a dotted line shows a temperature change of a base of the lower polishing plate, and a solid line shows a surface temperature change of the upper and lower polishing plates.

In consideration of the fact that the polishing process proceeds for a considerable time and at a considerable number of times, the physical deformation may be understood as a time-varying phenomenon. Thus, various factors such as the state of a slurry, dressing conditions and so on may be dynamic factors that are impossible to be determined quantitatively.

Under this circumstance, if wafer flatness and so on does not meet the standard quality, conventionally a carrier or a polishing plate was replaced by new one. However, the conventional technique is based on component replacement, and this replacement operation often requires a quality test for flatness and so on, resulting in prolonged process time. And, because a carrier and a polishing plate are replaced at an early stage, there is a considerable economic damage of raw subsidiary materials.

The conventional polishing apparatus has a wafer mounting hole of a fixed location, and thus repeatedly forms uniform rotation traces. For this reason, when flatness of a polishing plate or other dynamic factors vary, the conventional polishing apparatus can not take active measures against the varying environment. This is a fundamental problem of the conventional polishing apparatus.

Meanwhile, a carrier performs the most important function among flatness control factors in a double side polishing process. Generally, the carrier is made of epoxy glass or SUS DLC. Here, the SUS DLC is stainless steel with carbon coating.

Referring to FIG. 4, a carrier 130 having a wafer 100 mounted therein is interposed between an upper polishing plate 150 having an upper pad 151 attached thereto and a lower polishing plate 110 having a lower pad 111 attached thereto. The carrier 130 has a gear part along the outer periphery thereof. The gear part is engaged with an internal gear 120 at the inner periphery of a polishing apparatus and with a sun gear 140 at the outer periphery of the polishing apparatus.

The rotational momentum or torque by revolution and rotation of the carrier, in particular, an epoxy glass-made carrier is greatly applied to the outer periphery of the carrier having the gear part engaged with the internal gear and the sun gear. As the rotational motion continues, the applied force continues to accumulate at the outer periphery of the carrier, and in the end, cracks occur to the outer periphery of the carrier as shown in section A of FIG. 5.

The crack causes damage to an edge area of a polishing pad facing a wafer, and consequently, the pad is deformed and has an uneven surface. As a result, there is a deterioration in flatness of the wafer to be polished. And, substances detached from the damaged pad are included in the slurry, thereby making it difficult to filter the slurry.

That is, the epoxy-made carrier has risks of early deterioration in pad conditions caused by damage to the outer periphery thereof and reduction in flatness at wafer polishing. Further, the life cycle of the carrier is decreased.

Meanwhile, an SUS DLC-made carrier has higher rigidity than the epoxy-made carrier, and thus, has relatively less damage to the outer periphery thereof. However, the SUS DLC-made carrier has a limitation in thickness control, consequently a limitation in ensuring flatness of stable quality.

SUMMARY OF THE INVENTION

The present invention is designed to solve the above-mentioned problems, and therefore it is an object of the present invention to provide a carrier that has a mounting hole of a variable location and is capable of taking active measures against dynamic factors of a double side polishing process including flatness of a polishing plate.

And, it is another object of the present invention to provide a carrier of a differential configuration that has two polishing plates of different materials, thereby increasing the life cycle thereof and improving wafer flatness after double side polishing.

Other objects and advantages of this invention will become apparent from the following detailed description. And, the objects and advantages of the present invention may be realized and attained by means of the instrumentalities and combinations particularly pointed out in the appended claims.

In order to achieve the objects, the present invention provides a carrier for a double side polishing apparatus that is installed between an upper polishing plate and a lower polishing plate in the double side polishing apparatus and rotated by a sun gear and an internal gear. The carrier of the present invention comprises a center plate having a mounting hole where a wafer is mounted; and a circumferential plate having a fitting hole where the center plate is fitted and a gear part engaged with the sun gear and the internal gear and formed along the outer periphery thereof, wherein the center of the mounting hole is eccentric from the center of the center plate, and the center of the fitting hole is eccentric from the center of the circumferential plate.

The circumferential plate may be made of a material having a relatively higher rigidity than the center plate. In this case, the center plate may be made of an epoxy glass material, and the circumferential plate may be made of at least one material selected from the group consisting of SUS, SUS DLC and a metal.

And, the outer periphery of the center plate may have a plurality of protrusions, and the fitting hole of the circumferential plate may have grooves corresponding to the protrusions so that the protrusions are fittingly engaged with the corresponding grooves. In a further preferred embodiment, the protrusion and the groove may have steps corresponding to each other. More preferably, the protrusion or the groove may have a discriminable indicator.

More preferably, the center plate or the circumferential plate of the present invention may have at least one slurry hole.

Meanwhile, according to another aspect of the present invention, a double side polishing apparatus comprises an upper polishing plate and a lower polishing plate for polishing both sides of a wafer; a plurality of carriers, each carrier including a center plate and a circumferential plate, the center plate having a mounting hole where the wafer is mounted, the circumferential plate having a fitting hole where the center plate is fitted and a gear part formed along the outer periphery thereof, the center of the mounting hole being eccentric from the center of the center plate, the center of the fitting hole being eccentric from the center of the circumferential plate; and a sun gear and an internal gear engaged with the gear part of the circumferential plate to transmit a rotational force to the plurality of carriers, wherein a fitting direction of a center plate into a fitting hole can be adjusted for at least two carriers among the plurality of carriers.

According to yet another aspect of the present invention, a double side polishing apparatus comprises an upper polishing plate and a lower polishing plate for polishing both sides of a wafer; and a plurality of carriers, each carrier having a mounting hole where the wafer is mounted and a gear part formed along the outer periphery thereof; and a sun gear and an internal gear engaged with the gear part to transmit a rotational force to the plurality of carriers, wherein among the plurality of carriers, at least two carriers have mounting holes whose centers are eccentric from the centers of the carriers at different distances.

ADVANTAGEOUS EFFECTS

A carrier for a double side polishing apparatus according to the present invention and a double side polishing apparatus using said carrier do not fix a location of a wafer as the conventional art does so, but variably adjust a location of a wafer, thereby taking active actions against various dynamic factors of the polishing apparatus.

And, the present invention determines a direction for an optimum polishing quality through a test process and adjusts a location of a target wafer to the optimum direction through a simple structural adjustment, so that a subsequently polishing process is performed quickly and easily.

Specifically, the carrier has a dual configuration. In other words, the carrier has two polishing plates including a center plate where a wafer is mounted and a circumferential plate supporting the center plate. Accordingly, the location of the wafer can be variably adjusted only by changing a coupling direction of the center plate and the circumferential plate.

With the above-mentioned configuration, the present invention can solve all the conventional problems, such as frequent replacement of a carrier or a polishing plate, prolonged process time, increased cost, waste of raw subsidiary materials and so on, and remarkably increase productivity.

And, the present invention can effectively prevent wear, chipping, fissure or crack from occurring to a carrier of a double side polishing apparatus, and thus increase the life cycle of the carrier and extend a replacement cycle of the carrier in the apparatus.

Due to the above-mentioned basic effects, the present invention can continuously maintain the conditions of a polishing pad for polishing a wafer to good quality, and thus ensures high flatness and stability of a polishing process.

Additionally, the present invention can effectively reduce the process cost and time required to replace a carrier through the increased life cycle of the carrier, thereby improving economic efficiency and productivity.

BRIEF DESCRIPTION OF THE DRAWINGS

The accompanying drawings illustrate the preferred embodiments of the present invention and are included to provide a further understanding of the spirit and scope of the present invention together with the detailed description of the invention, and accordingly, the present invention should not be limitedly interpreted to the matters shown in the drawings.

DESCRIPTION OF THE PREFERRED EMBODIMENT

Hereinafter, the present invention will be described in detail with reference to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation.

Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
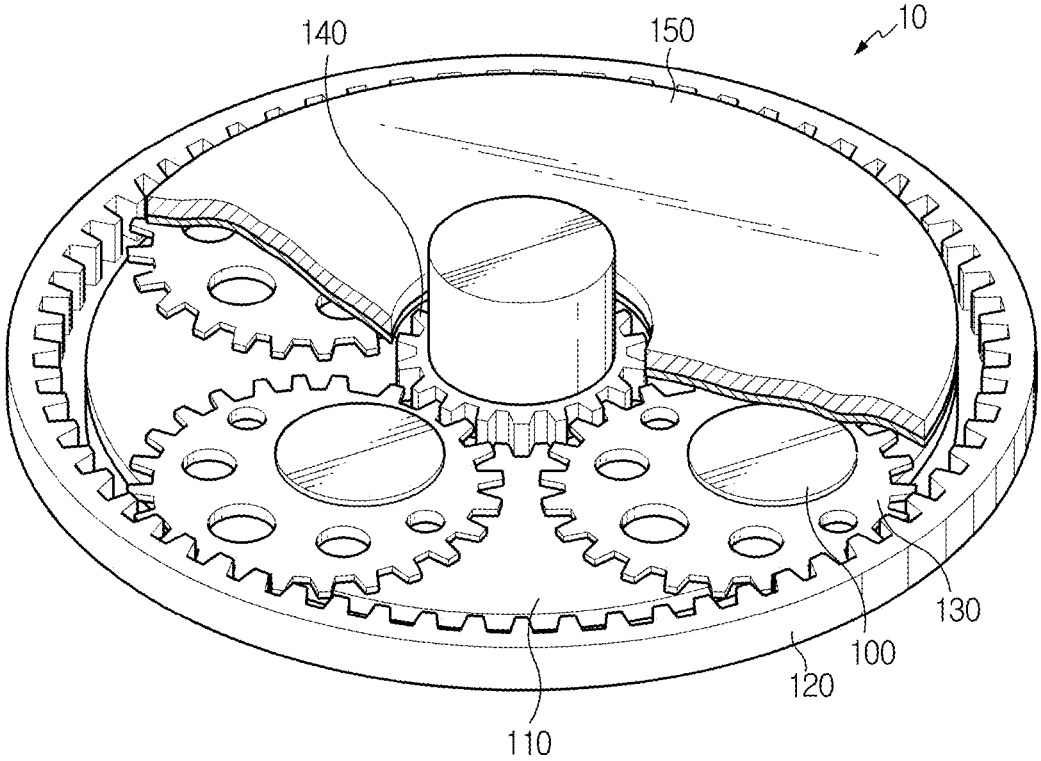
FIG. 1 (PRIOR ART)
FIG. 1 is an exploded perspective view of a conventional double side polishing apparatus.
Figure 2:
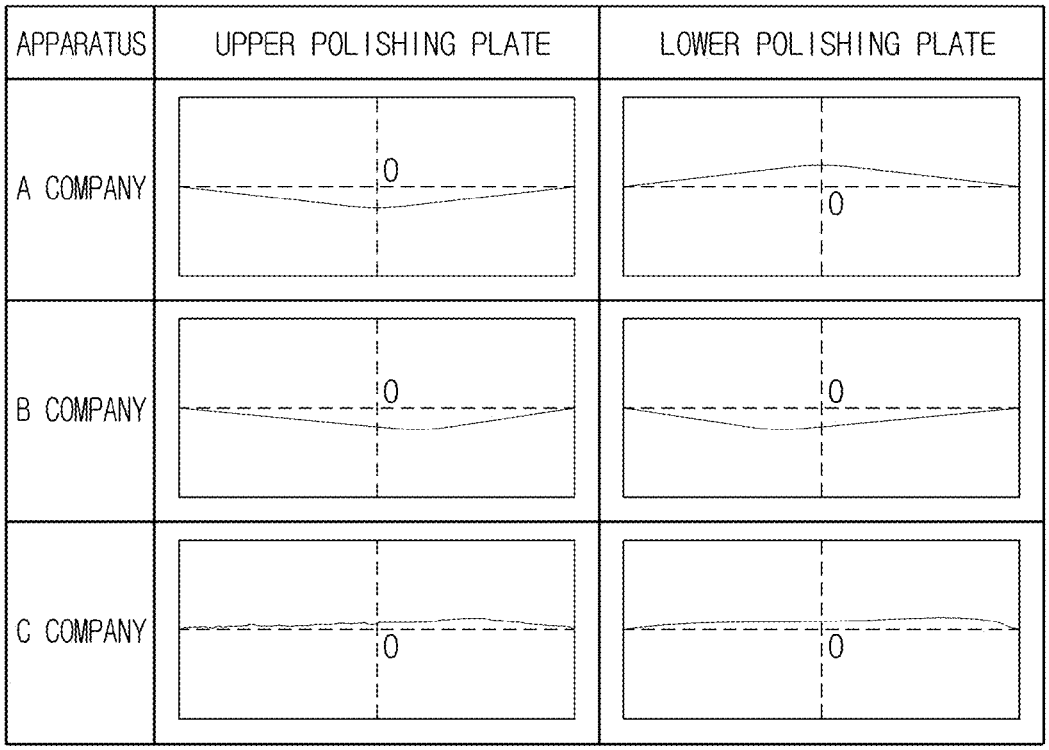
FIG. 2 (PRIOR ART)
FIG. 2 is a view showing flatness of upper and lower polishing plates in the conventional double side polishing apparatus.
Figure 3:
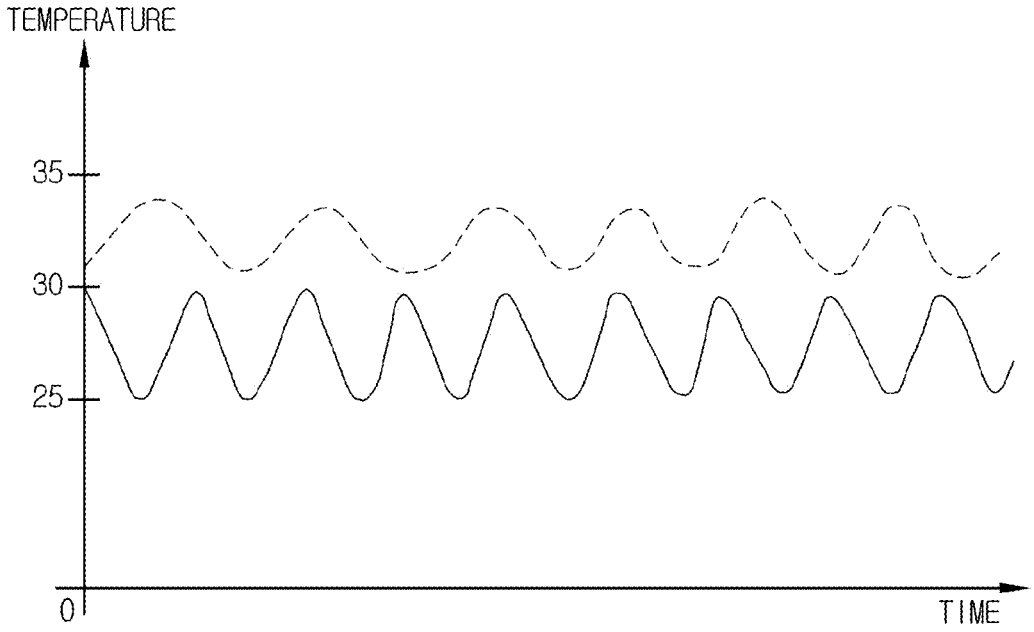
FIG. 3 (PRIOR ART)
FIG. 3 is a graph showing temperature increase caused by a conventional double side polishing process.
Figure 4:
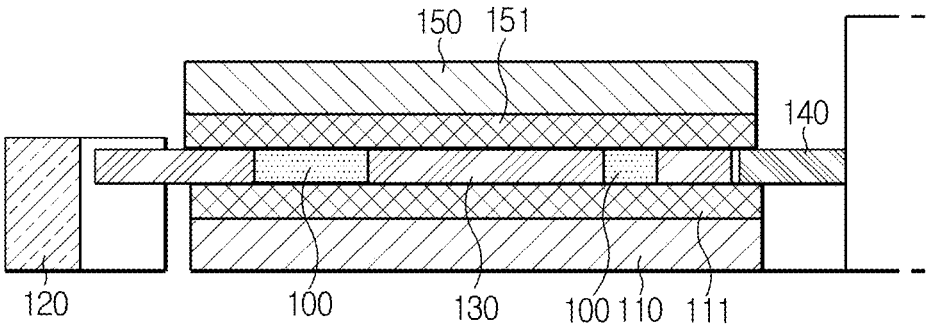
FIG. 4 (PRIOR ART)
FIG. 4 is a cross-sectional view of the conventional double side polishing apparatus.
Figure 5:
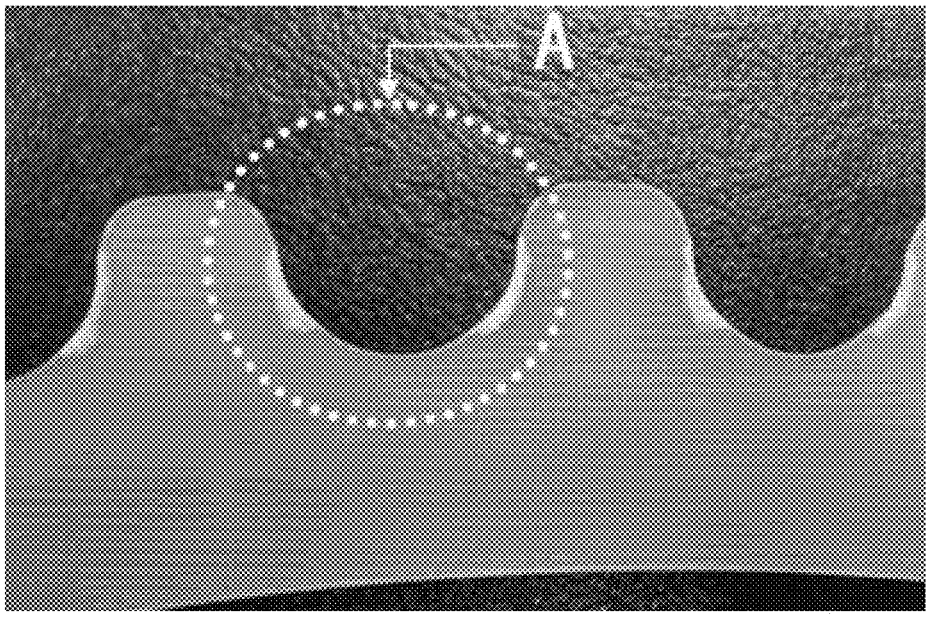
FIG. 5 (PRIOR ART)
FIG. 5 is a view showing cracks occurred to a conventional carrier made of a single material.
Figure 6:
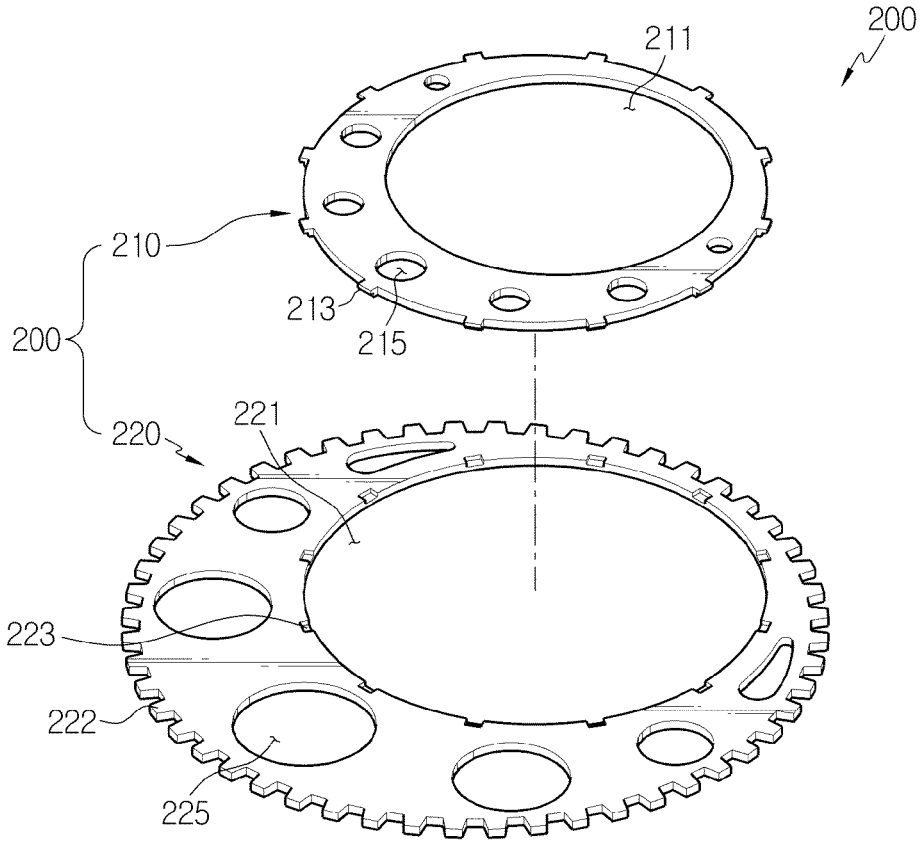
FIG. 6 is an exploded perspective view of a carrier for a double side polishing apparatus according to a preferred embodiment of the present invention.

FIG. 6 is an exploded perspective view of a carrier for a double side polishing apparatus according to a preferred embodiment of the present invention.

The carrier 200 of the present invention is a carrier for a double side polishing apparatus, and installed between an upper polishing plate and a lower polishing plate in a double side polishing apparatus. The carrier 200 is rotated by a sun gear and an internal gear. The carrier 200 of the present invention has a dual configuration. As shown in FIG. 6, the carrier 200 includes a center plate 210 and a circumferential plate 220.

Here, the center plate 210 may have a mounting hole 211 or a slurry hole 215. A wafer 100 to be polished is mounted in the mounting hole 211.

The slurry hole 215 is configured to promote mixing or reaction of a slurry that is a mixture of abrasive particles and various kinds of additives. At least one slurry hole 215 is formed at the center plate 210 to provide a sufficient space for a slurry hole. Similarly, at least one slurry hole 225 may be formed at the circumferential plate 220.

As mentioned above, if the slurry holes 215 and 225 are formed at the center plate 210 and the circumferential plate 220, respectively, a contact area is reduced between the center and circumferential plates and polishing pads of the upper and lower polishing plates, and consequently, a surface tension is minimized, thereby improving rotation of the carrier and favorably supplying a slurry to a wafer to be polished. As a result, wafer flatness is improved through polishing.

The present invention fundamentally changes the point of view on a conventional carrier having a wafer mounting hole of a fixed location and a conventional double side polishing apparatus, and suggests a carrier having a wafer mounting hole 211 of a variable location and a double side polishing apparatus using said carrier.

For this purpose, first, the mounting hole 211 is configured such that its center is eccentric from the center of the center plate 210 at a predetermined distance. Thus, the eccentric mounting hole 211 has a variable location according to embodiments in association with an eccentric structure of a fitting hole of the circumferential plate 220 as described below.

The circumferential plate 220 constitutes the carrier 200 of the present invention together with the center plate 210. The circumferential plate 220 has a fitting hole 221 into which the center plate 210 is fitted, and a gear part 222.

Similarly to the mounting hole 211, the fitting hole 221 is configured such that its center is eccentric from the center of the circumferential plate 220 at a predetermined distance. Thus, the eccentric fitting hole 221 can variably adjust the location of the mounting hole 211, in particular, the location of a wafer mounted in the mounting hole 211, in associated with the eccentric structure of the mounting hole 211.

The gear part 222 is formed along the outer periphery of the circumferential plate 220. And, the gear part 222 is engaged with the sun gear and the internal gear to transmit a rotational force for revolution and rotation. The rotational force transmitted through the gear part 222 of the circumferential plate 220 revolves and rotates the center plate 210 fit-coupled with the circumferential plate 220 and the wafer 100 mounted in the center plate 210.

The rotational force by revolution and rotation generates a relative frictional force between the wafer and the upper and lower polishing plates and induces a favorable supply of a slurry to the wafer through the slurry hole. In this way, a double side polishing process is performed.

And, according to a further preferred embodiment of the present invention, a plurality of protrusions 213 may be formed along the outer periphery of the center plate 210. The protrusions 213 may be fittingly engaged with corresponding grooves 223 of the circumferential plate 220.

The protrusion 213 and the groove 223 may have various shapes and types including teeth-notch for the purpose of an engagement therebetween and effective transmission of the rotational force. And, it is obvious to an ordinary person skilled in the art that the number of protrusions and grooves may be variously applied depending on coupling angles or directions.

Figure 7:
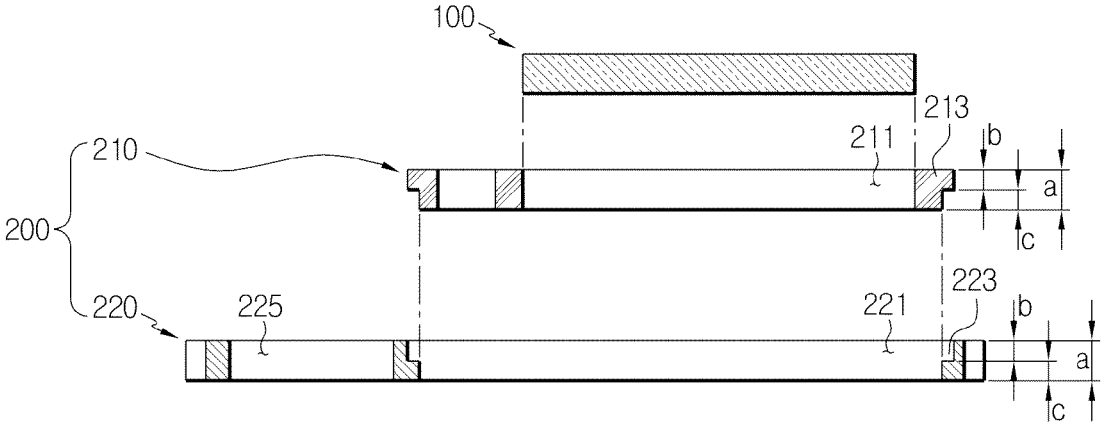
FIG. 7 is a cross-sectional view of the carrier for a double side polishing apparatus according to a preferred embodiment of the present invention.

For example, each of the protrusion 213 and the groove 223 may be preferably formed in the shape of a step, and the step-shaped protrusion 213 and the step-shaped groove 223 correspond to each other to effect a fitting engagement therebetween, as shown in FIGS. 6 and 7.

In this case, it can induce a more effective coupling between the center plate 210 and the circumferential plate 220, and stably maintain the coupling state although external factors occur due to operation of a double side polishing apparatus, for example, vibration, shaking and so on. Furthermore, it is easy to engage and disengage the center plate with/from the circumferential plate, and accordingly, a coupling direction of the center plate with the circumferential plate can be easily adjusted at any time.

As shown in FIG. 7, when thickness of the center plate 210 is 'a', and thickness of a convex portion of the step-shaped protrusion 213 is 'b' and thickness of a concave portion is 'c', preferably thickness of the circumferential plate 220 is 'a', and thickness of a concave portion of the step-shaped groove 223 is 'b' and thickness of a convex portion is 'c', so that the protrusion 213 of the center plate 210 corresponds to the groove 223 of the circumferential plate 220.

And, the protrusion 213 or the groove 223 is preferably provided with a discriminable indicator for a user to easily check and manage a coupling direction of the center plate 210 with the circumferential plate 220. The indicator is not limited to a specific type if it can be discriminated from one another. For example, the indicator may include color, symbol such as numeric character, and so on.

Meanwhile, a conventional carrier is made of a single material and has a shape of a single plate. As mentioned above, the conventional carrier has procedural problems according to the used materials. To solve the problems, the present invention provides a carrier of a dual configuration having a center plate and a circumferential plate. Thus, the present invention can overcome the defects related to wafer mounting, engagement structure with an internal gear or a sun gear, thickness control, physical rigidity and so on.

In the present invention, the center plate 210 is not engaged with the sun gear or the internal gear, and thus, a physical friction does not occur therebetween. Preferably, the center plate 210 is made of a material having less rigidity than the circumferential plate 220 to improve the efficiency of thickness control.

And, the circumferential plate 220 is directly and physically engaged with the sun gear and the internal gear.

Preferably, the circumferential plate 220 is made of a material having higher rigidity than the center plate 210 to ensure higher durability of physical engagement with the sun gear and the internal gear.

According to an embodiment for achieving another object of the present invention, the center plate 210 is preferably made of an epoxy glass. The circumferential plate 220 is preferably made of SUS, SUS DLC or a metal having higher rigidity than the center plate 210.

Hereinafter, a double side polishing apparatus 300 capable of variably adjusting a location of a wafer through a carrier of the above-mentioned dual configuration is described with reference to FIGS. 8 and 9.

The double side polishing apparatus 300 of the present invention includes a plurality of carriers 200. Hereinafter, the number of carriers is limited to five for the purpose of illustrations only.

Figure 8:
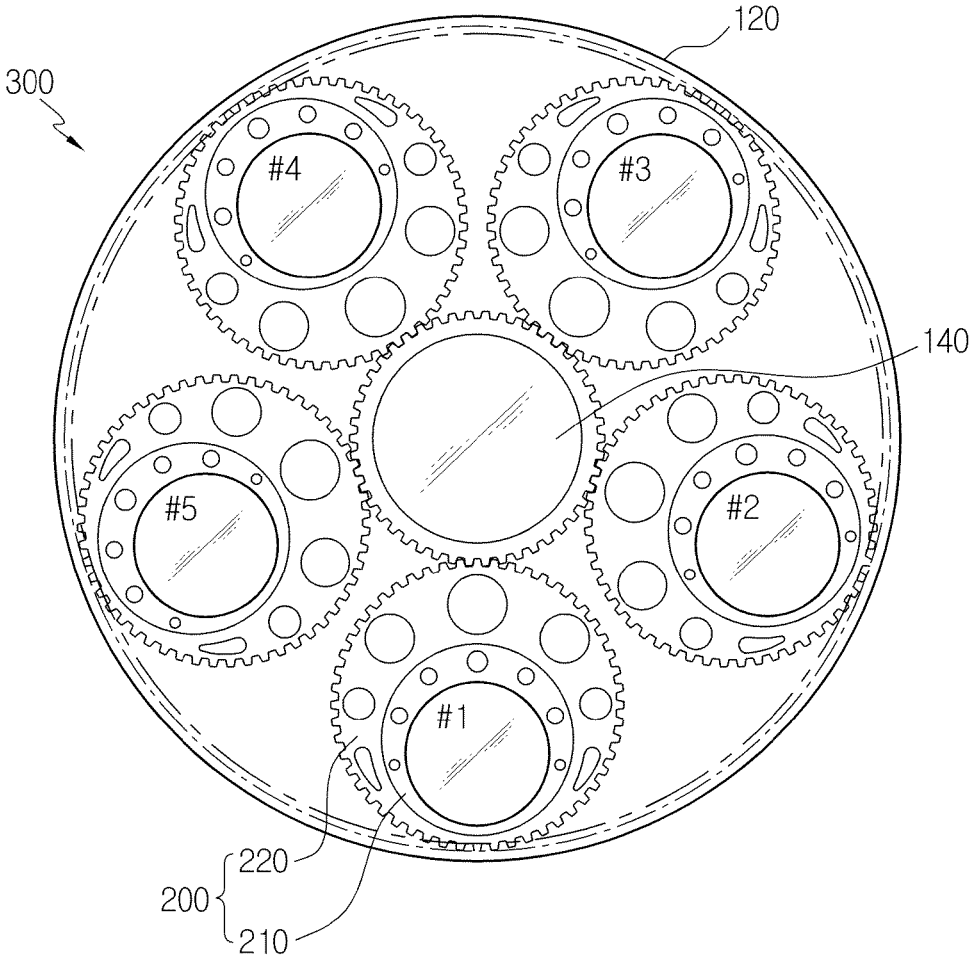
FIG. 8 is a plane view of a double side polishing apparatus according to a preferred embodiment of the present invention.

As shown in FIG. 8, five carriers 200 are designated as #1, #2, #3, #4 and #5 carriers. Each carrier 200 includes a center plate 210 and a circumferential plate 220. As mentioned above, the center plate 210 has an eccentric mounting hole 211. Similarly, the circumferential plate 220 has an eccentric fitting hole 221.

The center plates 210 are fittingly coupled with the circumferential plates 220 in different directions. Whereby wafers are put in different locations according to coupling directions of the center plates 210 with the circumferential plates 22 due to the eccentric structures of the mounting hole 211 and the fitting hole 221, as shown in FIG. 9.

Figure 9:
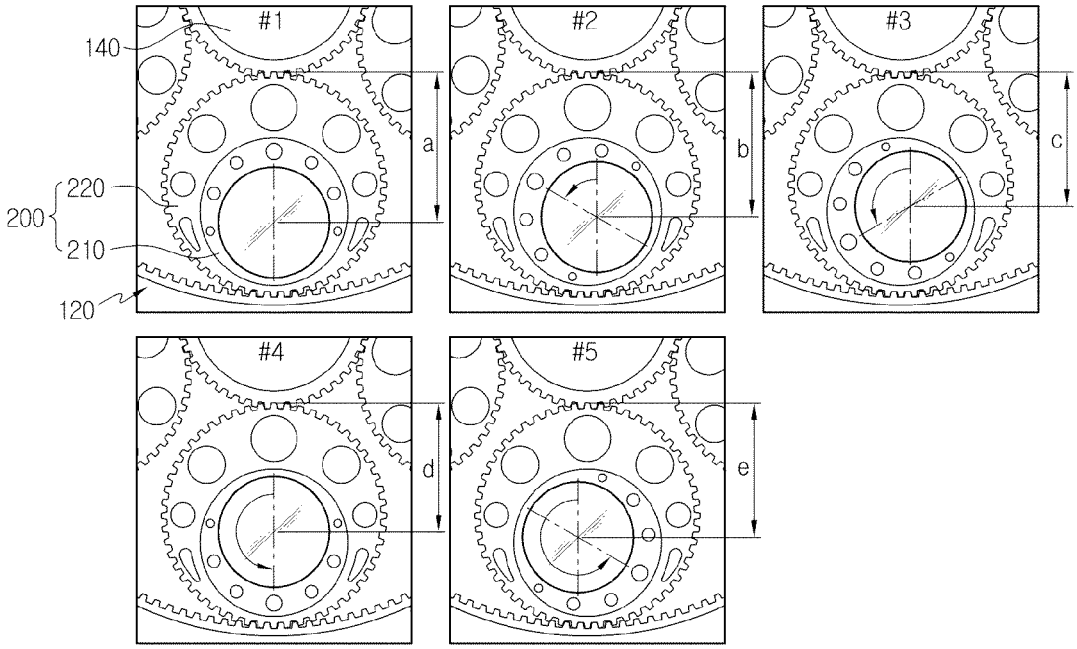
FIG. 9 is a view showing a wafer mounted in each carrier according to a preferred embodiment of the present invention.

Assuming that #1 carrier is a reference carrier as shown in FIG. 9, the following table 1 shows an angle of rotation of a wafer in each carrier, an eccentric distance and so on.

TABLE 1

| Classification | #1 carrier | #2 carrier | #3 carrier | #4 carrier | #5 carrier |
|---|---|---|---|---|---|
| Angle of rotation | 0 degree | 60 degrees | 120 degrees | 180 degrees | 240 degrees |
| Eccentric distance | a | b | c | d | e |
| Relative distance | | | a > b > c = e > d | | |

As shown in FIG. 9 and table 1, it varies how much the wafers put in different locations are eccentric from the center of the double side polishing apparatus or a predetermined reference point, thereby resulting in a differential diameter or trace of revolution or rotation of the wafers. Thus, differential polishing can be accomplished according to directions or locations of wafers.

Figure 10:
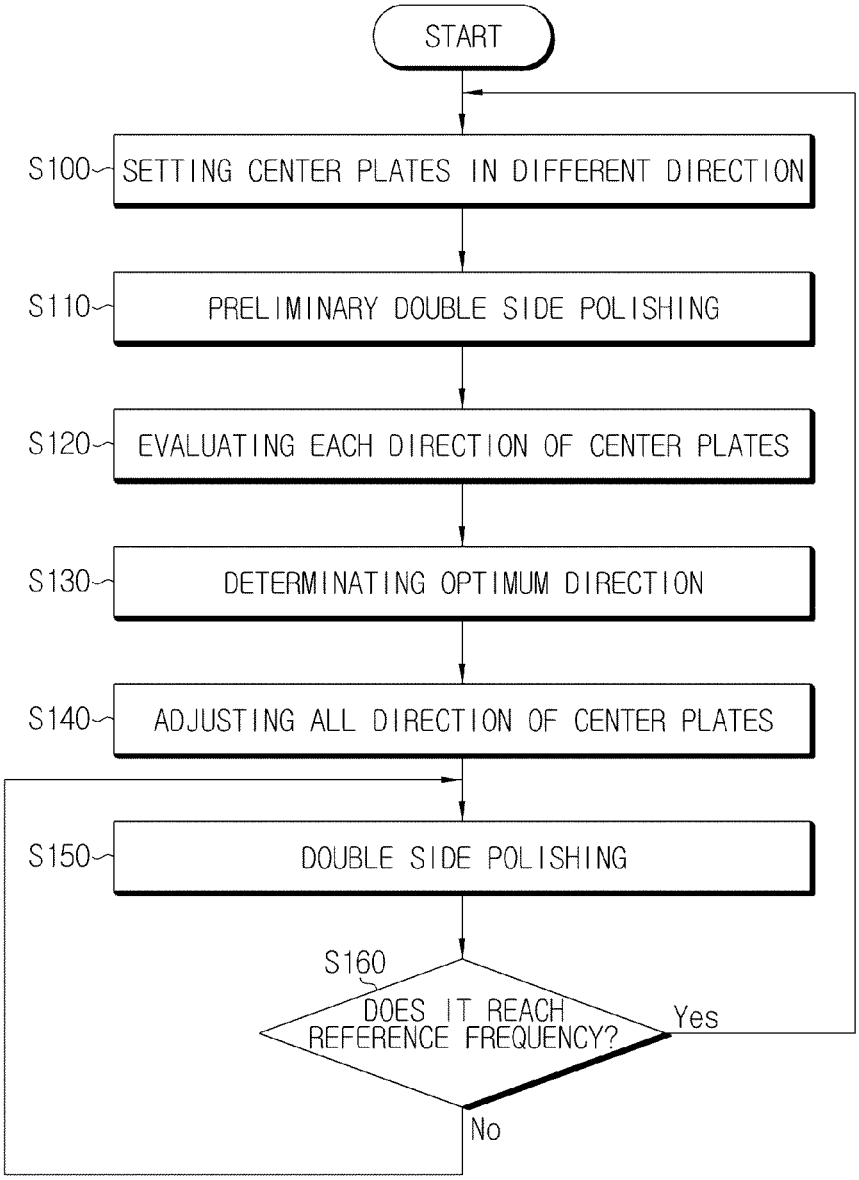
FIG. 10 is a flowchart of a double side polishing process according to a preferred embodiment of the present invention.

Hereinafter, a method for performing a double side polishing process using the double side polishing apparatus of the present invention is described with reference to FIG. 10.

First, the center plates 210 are fitted into the fitting holes 221 of the circumferential plates 220 such that the center plates 210 are put in at least one different direction as mentioned above (S100).

If the center plates 210 are fitted in different directions, wafers mounted in the center plates 210 are also put in different locations.

At this time, it is preferable to check and manage the directions of the center plate 210 and the circumferential plate 220 through matching between an indicator of the protrusion 213 of the center plate 210 and an indicator of the groove 223 of the circumferential plate 220.

After the center plates 210 are fitted, operation of a double side polishing apparatus is initiated to perform a preliminary double side polishing process (S110). After the preliminary double side polishing process is completed, a quality test is performed each direction of the center plate 210 to test wafer flatness and so on (S120). Then, a direction for optimum quality is determined through the test.

A first direction for an optimum quality is determined using the quality test results (S130). Then, the directions of the center plate are adjusted to the determined first direction (S140).

After the center plates 210 are set to a first direction as mentioned above, a double side polishing process is performed (S150). The double side polishing process is performed in consideration of dynamic factors such as current conditions of a polishing pad of an upper polishing plate or a lower polishing plate, wear, thermal deformation and so on. Accordingly, an optimum double side polishing process at the present conditions is performed.

However, the double side polishing process repeats many times. After the double side polishing process is performed many times, the dynamic factors may be changed and the direction for optimum quality may not be a direction for optimum quality any longer. For this reason, after the double side polishing process is performed a preset number of times, a direction for optimum quality should be determined again. That is, if the double side polishing process reaches a preset number of times, the above-mentioned steps S100 to S150 are performed again.

The preset number of times may be determined according to various parameters such as process line, system environment, the time required, product specification and so on.

Preferably, the preset number of times may be several tens to several thousands, more preferably 700 or so. As the double side polishing process repeats, a quality test may be performed twice or more.

Although this embodiment shows a carrier of a dual configuration having a center plate and a circumferential plate, the present invention is not limited in this regard. For example, the carrier may have a single integrated plate.

Figure 11:
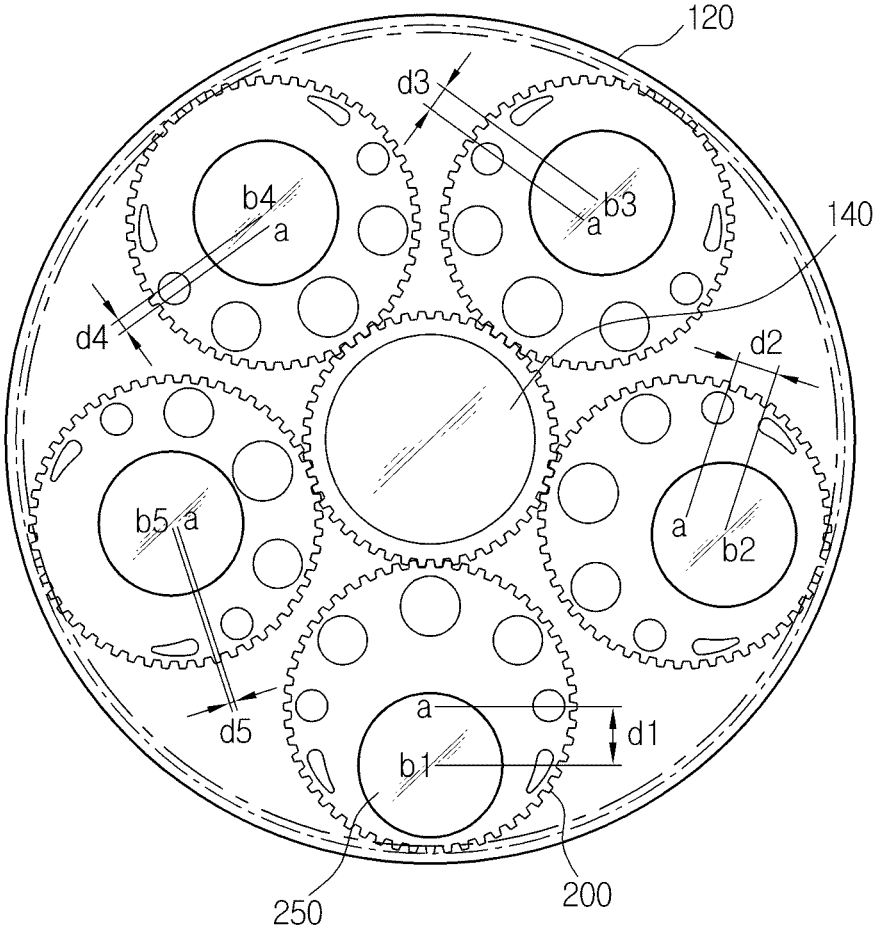
FIG. 11 is a plane view of a double side polishing apparatus according to another preferred embodiment of the present invention.

Referring to FIG. 11, a carrier 200 has a mounting hole 250 where a wafer is mounted, and a gear part engaged with a sun gear and an internal gear and formed along the outer periphery thereof. A double side polishing apparatus of this embodiment includes a plurality of carriers, for example, #1, #2, #3, #4 and #5 carrier. Among the carriers, at least two carriers may have mounting holes 250 whose centers are eccentric from the centers (a) of the carriers at different distances, b1, b2, b3, b4 and b5.

The #1, #2, #3, #4 and #5 carriers have different eccentric distances of the mounting holes 250, d1, d2, d3, d4 and d5, respectively. Thereby the carriers have different areas or traces of revolution and rotation.

Hereinabove, the present invention is described in detail with reference to the accompanying drawings. However, the description proposed herein is just a preferable example for the purpose of illustrations only, not intended to limit the scope of the invention, so it should be understood that other equivalents and modifications could be made thereto without departing from the spirit and scope of the invention.

What is claimed is:

1. A double side polishing apparatus, comprising:

an upper polishing plate and a lower polishing plate for polishing both sides of a wafer;

a plurality of carriers, each carrier including a center plate and a circumferential plate, the center plate having a mounting hole where the wafer can be mounted, the circumferential plate having a fitting hole where the center plate is fitted and a gear part formed along the outer periphery thereof, a center of the mounting hole being eccentric from a center of the center plate, a center of the fitting hole being eccentric from the center of a circumferential plate; and a sun gear and an internal gear engaged with the gear part of the circumferential plate to transmit a rotational force to the plurality of carriers, wherein a fitting direction of the center plate into the fitting hole is adjustable for at least two carriers among the plurality of carriers, so that each center of the mounting hole of the at least two carriers is eccentric from the center of each carrier at different distances from each other.

2. The double side polishing apparatus according to claim 1, wherein the outer periphery of the center plate has a plurality of protrusions, and wherein the fitting hole of the circumferential plate has grooves corresponding to the protrusions so that the protrusions are fittingly engaged with the corresponding grooves.

3. The double side polishing apparatus according to claim 2, wherein the protrusion and the groove have steps corresponding to each other.

4. The double side polishing apparatus according to claim 2, wherein the protrusion or the groove has a discriminable indicator.

5. The double side polishing apparatus according to claim 1, wherein the circumferential plate is made of a material having a relatively higher rigidity than the center plate.

6. The double side polishing apparatus according to claim 5, wherein the center plate is made of an epoxy glass material.

7. The double side polishing apparatus according to claim 5, wherein the circumferential plate is made of at least one material selected from the group consisting of SUS, SUS DLC and a metal.

8. The double side polishing apparatus according to claim 1, wherein the center plate or the circumferential plate has at least one slurry hole.

9. A double side polishing apparatus, comprising:

an upper polishing plate and a lower polishing plate for polishing both sides of a wafer;

a plurality of carriers, each carrier having a mounting hole where the wafer is mounted and a gear part formed along the outer periphery thereof; and a sun gear and an internal gear engaged with the gear part to transmit a rotational force to the plurality of carrier, wherein among the plurality of carriers, at least two carriers have mounting holes whose centers are eccentric from the centers of the carriers at different distances.

10. A carrier for a double side polishing apparatus, the carrier being installed between an upper polishing plate and a lower polishing plate in the double side polishing apparatus and rotated by a sun gear and an internal gear, the carrier comprising:

a center plate having a mounting hole where a wafer can be mounted; and a circumferential plate having a fitting hole where the center plate is fitted and a gear part engaged with the sun gear and the internal gear and formed along the outer periphery thereof, wherein a center of the mounting hole is eccentric from a center of the center plate and a center of the fitting hole is eccentric from a center of the circumferential plate, and wherein a fitting direction of the center plate into the fitting hole is adjustable, so that the center of the mounting hole is eccentric from the center of the carrier at different distances according to the fitting direction.

11. The carrier for a double side polishing apparatus according to claim 10, wherein the outer periphery of the center plate has a plurality of protrusions, and wherein the fitting hole of the circumferential plate has grooves corresponding to the protrusions so that the protrusions are fittingly engaged with the corresponding grooves.

12. The carrier for a double side polishing apparatus according to claim 11, wherein the protrusion and the groove have steps corresponding to each other.

13. The carrier for a double side polishing apparatus according to claim 11, wherein the protrusion or the groove has a discriminable indicator.

14. The carrier for a double side polishing apparatus according to claim 10, wherein the circumferential plate is made of a material having a relatively higher rigidity than the center plate.

15. The carrier for a double side polishing apparatus according to claim 14, wherein the center plate is made of an epoxy glass material.

16. The carrier for a double side polishing apparatus according to claim 14, wherein the circumferential plate is made of at least one material selected from the group consisting of SUS, SUS DLC and a metal.

17. The carrier for a double side polishing apparatus according to claim 10, wherein the center plate or the circumferential plate has at least one slurry hole.

* * * * *